US009145727B2

(12) United States Patent
Albers et al.

(10) Patent No.: US 9,145,727 B2
(45) Date of Patent: Sep. 29, 2015

(54) DEVICE FOR CONTROLLING A DRIVEN MOVING ELEMENT, FOR EXAMPLE, A DOOR

(75) Inventors: Bas Albers, Chur (CH); Beat De Coi, Sargans (CH); Peter Nebiker, Malans (CH)

(73) Assignee: Cedes AG, Landquart (CH)

( * ) Notice: Subject to any disclaimer, the term of this patent is extended or adjusted under 35 U.S.C. 154(b) by 1661 days.

(21) Appl. No.: 11/874,345

(22) Filed: Oct. 18, 2007

(65) Prior Publication Data

US 2008/0084300 A1 Apr. 10, 2008

Related U.S. Application Data

(63) Continuation of application No. PCT/EP2006/003577, filed on Apr. 19, 2006.

(30) Foreign Application Priority Data

Apr. 19, 2005 (DE) ..... 10 2005 018 231
May 19, 2005 (DE) ..... 10 2005 023 774

(51) Int. Cl.
*E05F 15/20* (2006.01)
*E05F 15/73* (2015.01)

(52) U.S. Cl.
CPC ..... *E05F 15/73* (2015.01); *E05Y 2400/322* (2013.01); *E05Y 2400/356* (2013.01); *E05Y 2400/415* (2013.01); *E05Y 2400/45* (2013.01); *E05Y 2900/132* (2013.01)

(58) Field of Classification Search
CPC ..... E05Y 2400/322; E05Y 2400/45; E05Y 2900/132
USPC ..... 49/25, 116, 118; 318/264, 265, 266, 318/272, 275, 277, 282, 286, 466, 467, 468
See application file for complete search history.

(56) References Cited

U.S. PATENT DOCUMENTS

| | | | | | |
|---|---|---|---|---|---|
| 4,029,176 | A | * | 6/1977 | Mills | 187/317 |
| RE30,719 | E | * | 8/1981 | Mills | 187/317 |
| 4,815,046 | A | * | 3/1989 | Dorr | 367/95 |
| 4,967,083 | A | * | 10/1990 | Kornbrekke et al. | 250/341.7 |
| 5,001,557 | A | * | 3/1991 | Begle | 348/166 |
| 5,420,430 | A | * | 5/1995 | Trett | 250/341.1 |
| 5,541,585 | A | * | 7/1996 | Duhame et al. | 340/5.62 |
| 5,583,405 | A | * | 12/1996 | Sai et al. | 318/286 |
| 5,627,439 | A | * | 5/1997 | Gregory et al. | 318/480 |
| 5,692,061 | A | * | 11/1997 | Sasada et al. | 382/106 |
| 5,884,237 | A | * | 3/1999 | Kanki et al. | 702/113 |
| 5,963,000 | A | * | 10/1999 | Tsutsumi et al. | 318/480 |
| 6,304,178 | B1 | * | 10/2001 | Hayashida | 340/545.1 |
| 6,329,774 | B1 | * | 12/2001 | Ariav | 318/282 |

(Continued)

FOREIGN PATENT DOCUMENTS

| | | | | |
|---|---|---|---|---|
| EP | 0 696 670 | A1 | 2/1996 | |
| JP | 03271485 | A * | 12/1991 | E05F 15/00 |
| JP | 08-285184 | A1 | 11/1996 | |

*Primary Examiner* — Jerry Redman
(74) *Attorney, Agent, or Firm* — Burr & Brown, PLLC

(57) ABSTRACT

A device for controlling a driven moving element including an electronic unit with an object sensor. According to the invention, the electronic unit is designed, by means of the object sensor, to determine an object distance between the driven moving element and an object in the region of the moving element and to control the movement of the moving element depending on said object distance.

11 Claims, 3 Drawing Sheets

(56) References Cited

U.S. PATENT DOCUMENTS

| | | | | |
|---|---|---|---|---|
| 6,345,105 | B1 * | 2/2002 | Nitta et al. | 382/100 |
| 6,452,353 | B1 * | 9/2002 | Calamatas | 318/466 |
| 6,678,999 | B2 * | 1/2004 | Zengguang et al. | 49/25 |
| 6,756,910 | B2 * | 6/2004 | Ohba et al. | 340/686.6 |
| 6,782,660 | B2 * | 8/2004 | Takada et al. | 49/25 |
| 6,970,085 | B2 * | 11/2005 | Okabe et al. | 340/545.6 |
| 7,045,764 | B2 * | 5/2006 | Beggs et al. | 250/221 |
| 7,332,999 | B2 * | 2/2008 | Fitzgibbon | 340/5.71 |
| 7,400,744 | B2 * | 7/2008 | Nichani et al. | 382/103 |
| 7,623,674 | B2 * | 11/2009 | Nichani et al. | 382/103 |
| 7,762,022 | B2 * | 7/2010 | Stadler et al. | 49/506 |
| 2002/0118114 | A1 | 8/2002 | Ohba et al. | |
| 2004/0200149 | A1 | 10/2004 | Dickmann et al. | |
| 2006/0087272 | A1 * | 4/2006 | Matsuyama et al. | 318/466 |
| 2008/0092443 | A1 * | 4/2008 | Herman et al. | 49/25 |

* cited by examiner

DEVICE FOR CONTROLLING A DRIVEN MOVING ELEMENT, FOR EXAMPLE, A DOOR

CROSS REFERENCE TO RELATED APPLICATIONS

This application is a continuation of International Application No. PCT/EP2006/003577 having an international filing date of Apr. 19, 2006, which designated the United States, and claims the benefit under 35 USC §119(a)-(d) of German Application No. 10 2005 018 231.3, filed Apr. 19, 2005, and German Application No. 10 2005 023 774.6, filed May 19, 2005, the entireties of which are incorporated herein by reference.

FIELD OF THE INVENTION

The present invention relates to a device for controlling a driven moving element, for example a door.

BACKGROUND OF THE INVENTION

In known embodiments, the closing of sliding doors is monitored by means of sensors which can detect an object in the path of movement of a door leaf, that is to say that the sensor ascertains whether or not an object is present. A further differentiation does not take place.

Accordingly, when an object is detected, the sliding door is always opened completely. In winter, however, the problem arises of keeping a sliding door closed, if possible, in order to avoid heat losses from rooms that can be entered via the sliding door.

One known solution for losing less heat in such situations consists in not opening the door completely. Since persons expect the door to open completely, a collision between persons and the door that has not been completely opened regularly occurs.

SUMMARY OF THE INVENTION

The present invention is based on the object of improving the control of a driven moving element by means of an optical sensor with regard to the opening and/or closing behavior.

The present invention is based on a device for controlling a driven moving element, for example a door, which device comprises an electronic unit with an object sensor. The heart of the invention resides in the fact that the electronic unit is designed, by means of the object sensor, to determine an object distance between the driven moving element and an object in the region of the moving element and to control the movement of the moving element depending on said object distance. By virtue of this measure, a sliding door, for example, can always be opened only precisely in such a way that an approaching object passing through the door, for example a person, can pass through the sliding door without any collisions. Accordingly, in winter, for example, the opening states and the degree of opening of the sliding door can be reduced to a minimum, whereby unnecessary heat losses from rooms that are entered through the sliding door can largely be avoided. The object sensor can be e.g. an optical sensor, a sensor for other electromagnetic waves, e.g. radar waves, and/or a sensor for sound waves, e.g. ultrasonic waves.

In a particularly preferred configuration of the invention, means are provided which determine the object distance from a distance between the object sensor and the object, a distance between the object sensor and the moving element and the angle between the distance directions.

In this way, the object distance is determined indirectly on the basis of two distances including the angle between the distances. As a result, by means of a central object sensor, for example, it is possible to determine any distance between moving element and object provided that the central object sensor can supply information about the distance to the moving element and to the object including the angle between these distances.

In a preferred embodiment, the electronic unit is designed to use a front edge of the moving element as reference at the moving element for determining the object distance. In the case of a door, the distance to the front edge thereof is preferably determined. This approach is based on the fact that the front edge collides first with an object, for example an approaching person, and the object distance should therefore be detected with respect to said front edge.

In a furthermore preferred configuration of the invention, the object sensor comprises a transmitter and receiver for a signal, e.g. for sound or electromagnetic waves, in particular light, wherein the electronic unit is designed to determine a distance which a signal emitted by the transmitter covers via a reflection surface to the receiver, by an evaluation of a signal profile, e.g. in the case of light, of a phase of an oscillation modulated onto the light, and to determine the object distance with this type of distance measurement. In principle, the signal can also appropriately be a pulsed signal, in the case of which e.g. a phase information item is evaluated. However, it is also conceivable, in principle, to evaluate a propagation time information item.

By means of this procedure, an object distance can be detected with comparatively high accuracy. The object distance to a plurality of objects can also be determined. By means of a plurality of measurements it is furthermore possible to calculate the time characteristic of the object distance, that is to say the velocity, such that the object velocity can be incorporated into the control of the driven moving element, for example a door.

Besides the object velocity, it is also possible in this way to determine the velocity of the driven moving element, which is important in the same way for an optimum control of the driven moving element.

In a furthermore preferred configuration of the invention, the electronic unit performs the control of the driven moving element in such a way that the distance between a location of the driven moving element, preferably the front edge of the driven moving element, and the object is kept at least approximately at a predetermined value. Preferably, the object distance is kept at least in sections at a predetermined value. In a preferred configuration, it is expedient to determine the object distance continuously, e.g. multiply per second. In an additionally preferred configuration, the object distance is kept at a predeterminable constant value. Keeping it constant prevents a collision between object and moving element from occurring. It is also possible, however, for the predeterminable value to follow a function. A variation of the predetermined distance depending on the distance between the object and the driven element or a door plane would be conceivable. The predetermined distance can also be made dependent on whether the person is still in front of the door, passing through the door or past the door. The function can also be a discrete function. It is also possible for parameter fields to be predetermined, e.g. a look-up table. For the case where the predeterminable value represents a minimum value, the latter is preferably dependent on the deceleration distance of the driven moving element and/or on empirically determined "feel-good parameters", that is to say values for which a person passes the driven moving element with a pleasant feeling. The minimum value will advantageously be greater than 10 cm.

In the case of a plurality of moving elements, it is preferred if all the moving elements can be controlled independently. The best possible movement sequences can thereby be obtained for the individual moving elements.

For the case where a plurality of driven moving elements that cannot be moved independently are provided, it is advantageous if the smallest distance determined to a moving element, in particular to the front edge of a moving element, is crucial for the control of the moving elements.

By means of this procedure, at least a partly optimized movement of the moving elements can be achieved in conjunction with a control outlay that has essentially not been increased.

The invention can be applied in particular to sliding doors, leaf doors, vertical doors, folding doors and also windows.

A further improvement in the control of the movement of the driven moving element can be obtained by virtue of the fact that, in an advantageous configuration of the invention, the electronic unit generates a control signal for the control of the driven moving element which takes account of a deceleration distance of the driven moving element. The object distance can thereby be optimized even further with regard to its minimum, which can be utilized positively when reducing opening states, for example of a sliding door.

In order to obtain an even more refined control of the driven moving element with regard to opening and/or closing states of the moving element, it is furthermore proposed that the electronic unit controls the driven moving element in such a way that the moving element, for example a door, is closed as rapidly as possible after an object, for example a person, has passed the moving element, and/or that the moving element, for example a door, is opened as late as possible when an object, for example a person, moves toward the moving element.

In a furthermore preferred configuration of the invention, the electronic unit controls the velocity of the moving element to an inherently undisturbed movement path depending on the object distance. By virtue of this measure, an increased velocity can be predetermined e.g. in the case of comparatively large object distances, the velocity being progressively reduced upon correspondingly approaching the object. The velocity adaptation can be effected e.g. in a stepwise manner.

It is furthermore preferred if the electronic unit performs the control in such a way that if the moving element is blocked for longer than a predetermined time, it ends the closing operation with gentle pressure.

BRIEF DESCRIPTION OF THE DRAWINGS

Various exemplary embodiments of the present invention are shown in the drawings and are explained in more detail below with indication of further advantages and details.

DETAILED DESCRIPTION OF THE INVENTION

Figure 1:
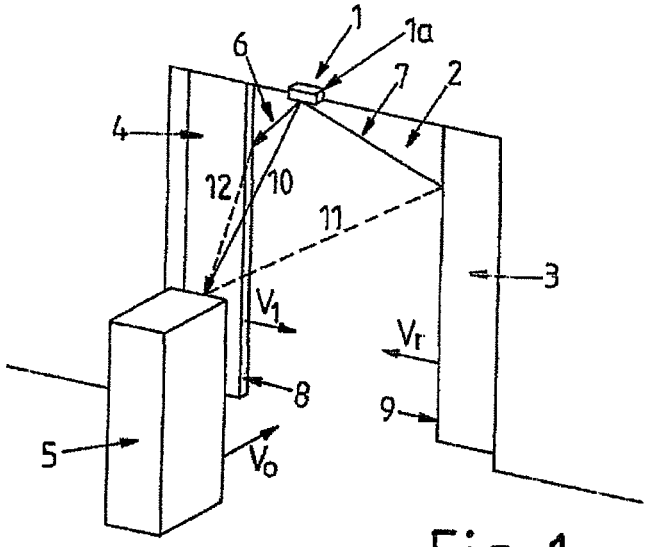
FIG. 1 shows, in a schematic three-dimensional view, an optical door sensor arrangement of a two-leaf sliding door with approaching object.

FIG. 1 illustrates an optical door sensor arrangement 1 on a sliding door 2 with an optical sensor 1*a* above the sliding door 2. Leaves 3, 4 of the sliding door 2 are partly open and close precisely with velocities $V_l$ and $V_r$. An object 5, for example a person, is moving toward the sliding door 2 at a velocity $V_o$.

The door sensor arrangement 1 detects 3D images of its surroundings. A built-in computer (not illustrated) analyzes the images and determines therefrom the position and velocity of the sliding door leaves 3, 4 and of the object 5. FIG. 1 illustrates vectors 6, 7 and 10 for three pixels from an image determined in this way. The vectors 6 and 7 are directed at pixels of edges 8, 9 of the respective leaves 3, 4 and the vector 10 is directed at a pixel of the object 5. Normally, the edges 8, 9 of the leaves 3, 4 and also the object 5 are detected simultaneously over a plurality of pixels. A higher accuracy and hence reliability can thereby be obtained. However, the inventive procedure is explained on the basis of the three selected vectors with respect to the corresponding pixel.

Figure 3:
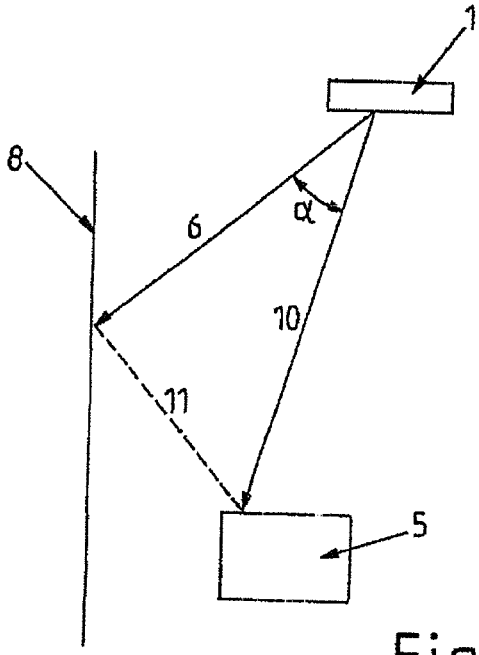
FIG. 3 shows a schematic illustration illustrating the method of determining the distance between a sliding door edge and an object.

The positions of the pixels can be determined by means of the vectors 6, 7 and 10. For determining an object distance 11, 12 (see FIG. 3), that is to say in the present case a distance between the respective front edge 8, 9 of the sliding door leaves 4, 5, and the object 5, it is possible to determine the angle between the vectors 6 and 10. The distance 11, 12 between the object 5 and the respective leaf edge 8, 9 can then be calculated by means of the magnitudes of the vectors 6 and 10.

From a plurality of such measurements, it is additionally possible to determine the relative velocity from the object 5 to the two door leaf edges 8, 9. This makes it possible to foresee if the object would collide with one of the two door leaf edges 8, 9. The door leaves 3, 4 can thus be stopped, possibly separately, in order to avoid a collision. The deceleration distance of the door leaves 3, 4 can additionally be taken into account in this operation. In conventional door controls with a light grating or light curtain, by contrast, only the presence of an object can be ascertained.

Figure 2A:
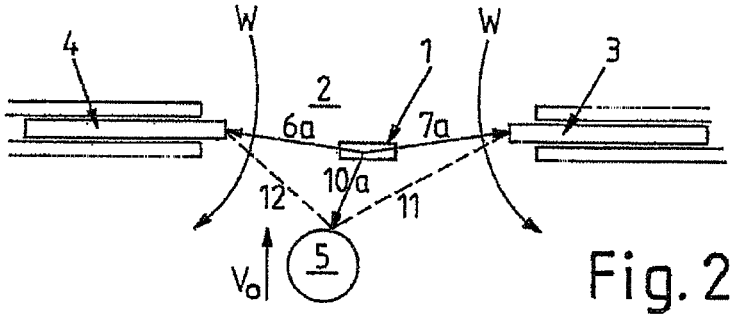
FIGS. 2*a-c* show movement states of the two-leaf sliding door according to FIG. 1 during the passage of an object, in plan view.

FIG. 2*a* shows the object 5 moving in the direction of sliding door 2. The door sensor arrangement 1 detects the distance 10*a* to the object 5 and the distances 6*a*, 7*a* to the door leaf edges 8, 9. From these distances 6*a*, 7*a*, it is possible to calculate the distances 11, 12 between the object 5 and the door edges taking account of the angle between the distances 6*a* and 10*a*, and 7*a* and 10*a*. The distances 11, 12 are communicated to a door control, whereby the movement and position of the door leaves 3, 4 can be controlled depending on the distances 11, 12.

Figure 2B:
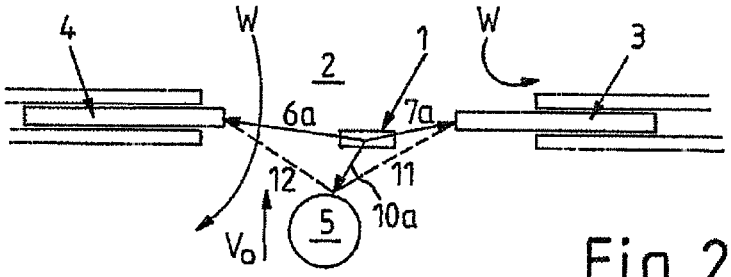

FIG. 2*b* shows the situation in which the door leaf 3 is partly closed, for example in order that less warm air (symbolized by the arrows W) can escape from a room that is entered through the door 2. In this case, not only the current position of the object 5 but also the velocity thereof and the velocity of the door leaves 3, 4 are taken into account.

For the case where the door leaves 3, 4 cannot be moved separately, the control can be established in such a way that that door leaf which would cause a collision with the object 5 the most rapidly is crucial.

Figure 2C:
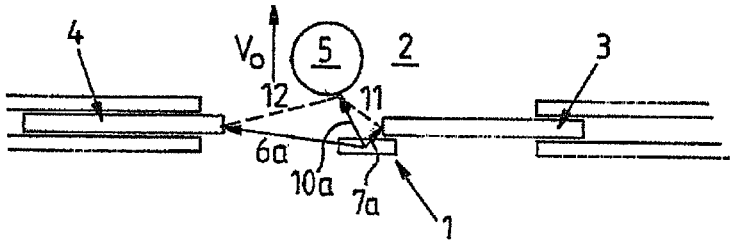

If the object has passed through the door 2, as shown in FIG. 2*c*, the door leaf 4 can also be closed.

Figure 4:
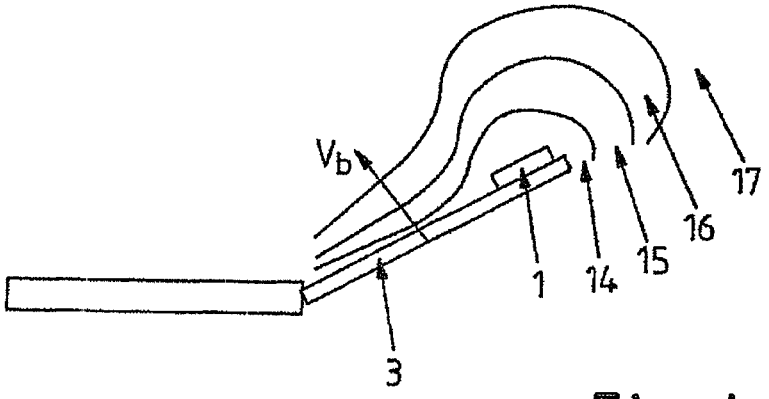
FIG. 4 shows a schematic plan view of a leaf door for illustrating the velocity control of the leaf door.

FIG. 4 illustrates a leaf door 3 with symbolized velocity regions 14, 15, 16, 17. If the leaf door 3 opens at a velocity $V_b$, the door sensor arrangement 1 monitors regions 14, 15, 16, 17. If somebody is situated within the region, then the leaf door 3 is stopped. If an object is situated within the region 15, then the procedure continues in slowed-down fashion. If an object is situated within the region 16, then the procedure continues comparatively more rapidly, and within the region 17 the door is moved at normal velocity.

We claim:

1. A device for controlling a driven moving element, the device comprising an electronic unit with an object sensor, wherein the object sensor of the electronic unit is an optical sensor that is arranged above the driven moving element and which determines an object distance between the driven moving element and an object in the region of the driven moving element and controls movement of the driven moving element depending on the object distance, wherein the electronic unit uses only a front edge of the driven moving element, which is a first part of the driven moving element that would otherwise collide with the object, as a reference for the driven moving element to determine the object distance.

2. The device as claimed in claim 1, wherein the device comprises means to determine the object distance based on a distance between the object sensor and the object in a first distance direction, a distance between the object sensor and the driven moving element in a second distance direction, and an angle $\alpha$ between the first and second distance directions.

3. The device as claimed in claim 1, wherein the object sensor comprises a transmitter and signal receiver, wherein the electronic unit determines a distance over which a signal emitted by the transmitter travels via a reflection surface to the receiver by evaluating a signal profile to determine the object distance.

4. The device as claimed in claim 1, wherein the electronic unit generates a control signal for controlling the driven moving element depending on at least one of a velocity ($V_0$) of the object and a velocity ($V_l$, $V_r$) of the driven moving element.

5. The device as claimed in claim 1, wherein the electronic unit controls the driven moving element so that the object distance between a location of the driven moving element, and the object is kept at a predetermined value.

6. The device as claimed in claim 1, wherein a plurality of driven moving elements are controlled independently.

7. The device as claimed in claim 1, wherein the electronic unit generates a control signal for controlling the driven moving element, taking into account a deceleration distance of the driven moving element.

8. The device as claimed in claim 1, wherein the electronic unit controls the driven moving element so that the driven moving element is closed as rapidly as possible after the object has passed the driven moving element, and so that the driven moving element is opened as late as possible when the object moves toward the driven moving element.

9. The device as claimed in claim 1, wherein the electronic unit controls a velocity of the driven moving element, based on an undisturbed movement path, depending on the object distance.

10. The device as claimed in claim 1, wherein the electronic unit controls the driven moving element so that the object distance between the front edge of the driven moving element and the object is kept at a predetermined value.

11. The device as claimed in claim 1, wherein when the plurality of driven moving elements are not moved independently, the electronic unit controls the movement of the driven elements based on a distance between the object and the front edge of one of the driven moving elements that is closest to the object.

* * * * *